United States Patent [19]

Gavaghan et al.

[11] Patent Number: 4,637,602

[45] Date of Patent: Jan. 20, 1987

[54] DOCUMENT GUIDE APPARATUS FOR PREVENTING JAMS

[75] Inventors: Thomas J. Gavaghan, Norwalk; Paul D. Boucher, Sandy Hook; Karel Janatka, Southbury, all of Conn.

[73] Assignee: Pitney Bowes Inc., Stamford, Conn.

[21] Appl. No.: 806,870

[22] Filed: Dec. 9, 1985

[51] Int. Cl.[4] ..... B65H 9/00

[52] U.S. Cl. ..... 271/238; 271/240; 271/248; 271/253

[58] Field of Search ..... 271/238, 248, 249, 250, 271/240, 253, 254, 255, 171, 223

[56] References Cited

U.S. PATENT DOCUMENTS

| | | | |
|---|---|---|---|
| 998,663 | 7/1911 | Wood | 271/171 |
| 1,881,138 | 10/1932 | Schott, Jr. | 271/254 |
| 2,729,136 | 1/1956 | Feick et al. | 88/14 |
| 2,938,723 | 5/1960 | Paulson | 271/49 |
| 2,974,953 | 3/1961 | Kaschner, Sr. | 271/59 |
| 3,175,821 | 3/1965 | Gibson | 271/9 |
| 3,807,725 | 4/1974 | Bookless | 271/171 |
| 4,501,417 | 10/1982 | Foster et al. | 271/124 |
| 4,548,400 | 10/1985 | Foster et al. | 271/238 |

*Primary Examiner*—John J. Love
*Assistant Examiner*—John A. Carroll
*Attorney, Agent, or Firm*—Lawrence E. Sklar; David E. Pitchenik; Melvin J. Scolnick

[57] ABSTRACT

There is disclosed a registration device for use with an envelope inserting machine. The device includes a pair of support members which are L-shaped, and which each have an elongated first portion extending parallel to the feed deck of the machine. A second portion of the members reaches laterally outward and overlies a pair of laterally disposed support members which extend from the feed deck. There is a registration guide member placed over an L-shaped portion of each support member, such that an internal corner of each guide member provides a guide and support for documents moving parallel and between the guides. The guides are clamped to the deck to ensure that documents cannot jam between the guide and the deck.

6 Claims, 5 Drawing Figures

DOCUMENT GUIDE APPARATUS FOR PREVENTING JAMSP

FIELD OF THE INVENTION

BACKGROUND OF THE INVENTION

The present invention relates to an envelope inserting machine for processing varying sized of insert material which is loaded by a machine operator into a plurality of feeders in the inserter. The scope of the envelope inserting machine is such that a wide range of sizes of sheets, documents, tabulating cards or other enclosure material is processed and deposited into envelopes which are registered and appropriately positioned on the output end of the machine.

The typical envelope inserting machine has a frame for supporting the plurality of feeders an an aligned row. Each feeder is programmed to deliver one or more documents by a predetermined method which utilizes a signaling device such as a printed code on a master enclosure document. In this way, the feeders deliver sequential enclosures to a cyclic conveyor, which in turn pushes the individual or stacked enclosures along a path leading to an appropriate waiting envelope located downstream at an inserting station.

It is along the conveying path that the enclosures are pushed where document jams and lateral misguiding of the enclosures frequently occurs and which in turn results in decreased effectiveness of the through-put capability of the inserting machine due to machine down time and increased operator maintenance. The guiding devices presently utilized for lateral positioning and guiding of the enclosure documents provides undesirable gaps, openings and seams for causing those documents to become jammed at their leading end corners or lateral edges.

The apparatus to be defined and described in the present disclosure has been instrumental in virtually eliminating the foregoing mentioned problems with respect to jams of moving document enclosures. In addition, there is a need to have a document guide apparatus which is readily interchangeable between different sheet guide areas of the sheet processing machine in those cases where the length of the sheet or document may vary from one document feed station to another. In some instances, it is advantageous to be able to match the guide apparatus to the document width and length. Therefore, having briefly described the background of the present invention, a brief summary of the prior art is now provided.

THE PRIOR ART

U.S. Pat. No. 4,501,417 issued to Foster, et al for an Inserter Feeding Assembly illustrates the assembly and use of a sloped tray and a pair of side guides which engages the ends of the stack of materials being fed. There is an adjustment means provided for the side guides. This type of sheet guide is adapted to the supply station of the sheets, where a stack of sheets lie while being separated and fed forward to a downstream located conveyer and receiving station. The guides described do not adapt as described to the downstream receiving station because of the reasons cited in the background of the present invention.

U.S. Pat. No. 2,938,723 issued to H. E. Paulson, describes a Side Guide Register for Sheet Feeders.

U.S. Pat. No. 2,729,136 issued fo D. E. Feich, et al describes an Apparatus for Detecting Pin Holes in Sheets.

U.S. Pat. No. 1,881,138 issued to F. J. Schott, Jr. describes a Paper Guide.

In all of the foregoing listed prior art, the sheet guiding apparatus is not suitable to provide reliable guiding of sheets, documents or the like where the article is being conveyed one at a time along a path leading to a conveyor, or receiving station for further processing. Therefore, having briefly discussed the prior art, a brief summary of the present invention is given.

SUMMARY OF THE INVENTION

There is disclosed an envelope inserting machine having an elongated feed deck, with an apparatus for advancing insert material along the feed deck. There is a plurality of insert material feeding devices spaced along the feed deck for sequentially feeding insert material onto the feed deck in registration with insert material advancing along the feed deck to registration devices.

There is a plurality of support members connected to the feed deck which extend laterally outwards from the feed deck. There is provided a plurality of body members, each having a first portion overlying the feed deck and which extend parallel thereto, and a second portion extending laterally outwardly from the first portion and overlying the support members. There is a registration guide apparatus mounted on the first portion of each of the body members for guiding the insert material into registration with other insert material on the feed deck. The guide apparatus has a generally upright and L-shaped configuration which defines a closed unitary corner along which the lateral edge of the insert material moves. There is an apparatus for slidably clamping the second portion of each of the body members to the support member underlying the second portion of each of the body members in a desired lateral position with respect to the feed deck to force each of the guide apparatus mounted on the first portion of each of the body members into intimate contact with the feed deck whereby the guide apparatus forms a continuous horizontal support for said insert material to prevent the lateral edges of the insert material from being caught between the upper surface of the feed deck and the registration guide.

The insert material registration devices with the first portion of each of the body members includes an elongate upstanding flange extending generally parallel to the feed deck. The registration guide apparatus includes an upstanding generally U-shaped portion which fits over the upstanding flange of the body member and a unitary horizontal flange overlying the feed deck, the U-shaped portion and the horizontal flange forming the closed unitary corner.

OBJECTS OF THE INVENTION

It is a primary object of the present invention to provide a registration device suitable to guide documents such as insert enclosures from an upstream position to a downstream position without a jam occurrence.

It is another object of the present invention to provide a registration device suitable for rapid lateral adjustment by an operator in order to accommodate varying widths of documents.

It is yet another object of the present invention to provide a registration device which is easily exchanged with other similar devices of longer or shorter guiding capacity.

DESCRIPTION OF THE PREFERRED EMBODIMENT

Figure 1:
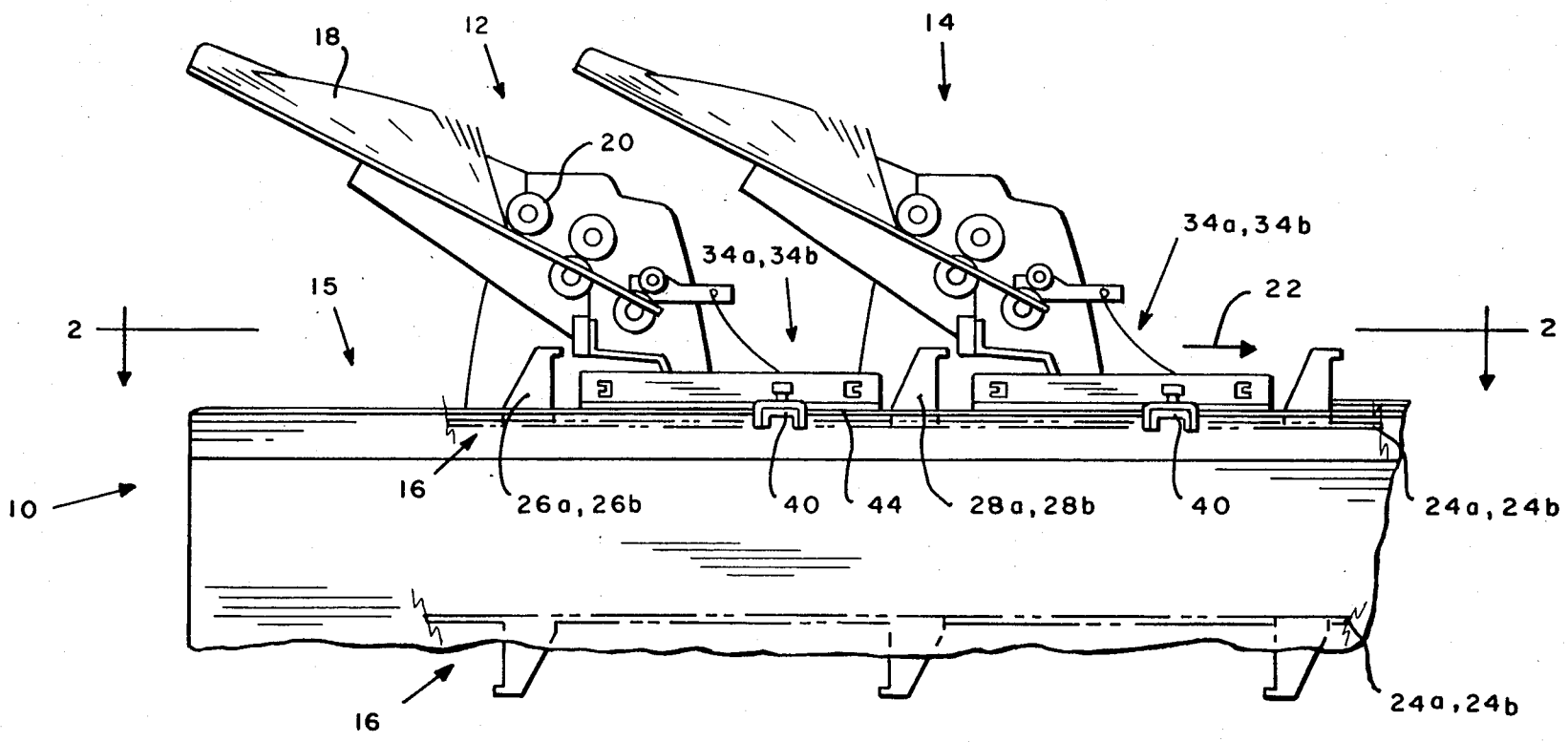
FIG. 1 is a partial side view of an inserting machine showing two of a plurality of document feeders mounted over the feed deck, and having document guide apparatus located on the feed deck adjacent to each insert feeding apparatus.

Referring to FIG. 1, there is shown a section of an inserting machine 10. It is typical of such machines that there is a plurality of feeders for feeding sheets, enclosures, or insert material. In FIG. 1, an insert feeder 12, and another insert feeder 14 are disposed such that material fed from the feeders 12 and 14, and other such feeders is sequentially fed to a horizontally disposed feed deck 15, which is fabricated of steel or other suitable material and along which a cyclic, endless conveyer 16 is provided to receive the insert material as it is advanced from the feeders.

The insert feeder 12 has a supply 18 of inserts which are separated on demand by a cyclicable feed wheel 20. The feed wheel 20 is actuated by an appropriate electromagnetic clutch (not shown), but which will be understood to be engaged with a main drive member such as an electric motor of the machine 10. At this point it will be helpful to recall the reference U.S. Pat. No. 4,501,417 issued to D. Foster and H. Silverman and assigned to Pitney Bowes. The reference patent mentioned may be referred to in order to gain a better understanding of the operation and workings of a inserter feeder assembly. In addition, the referenced patent will explain how a feed wheel such as wheel 20 in the present application is operatively engaged in the cycle of the inserter so that the insert material meets the conveyor 16. The insert material is operatively conveyed along a path 22, which leads downstream in the machine 10.

Figure 2:
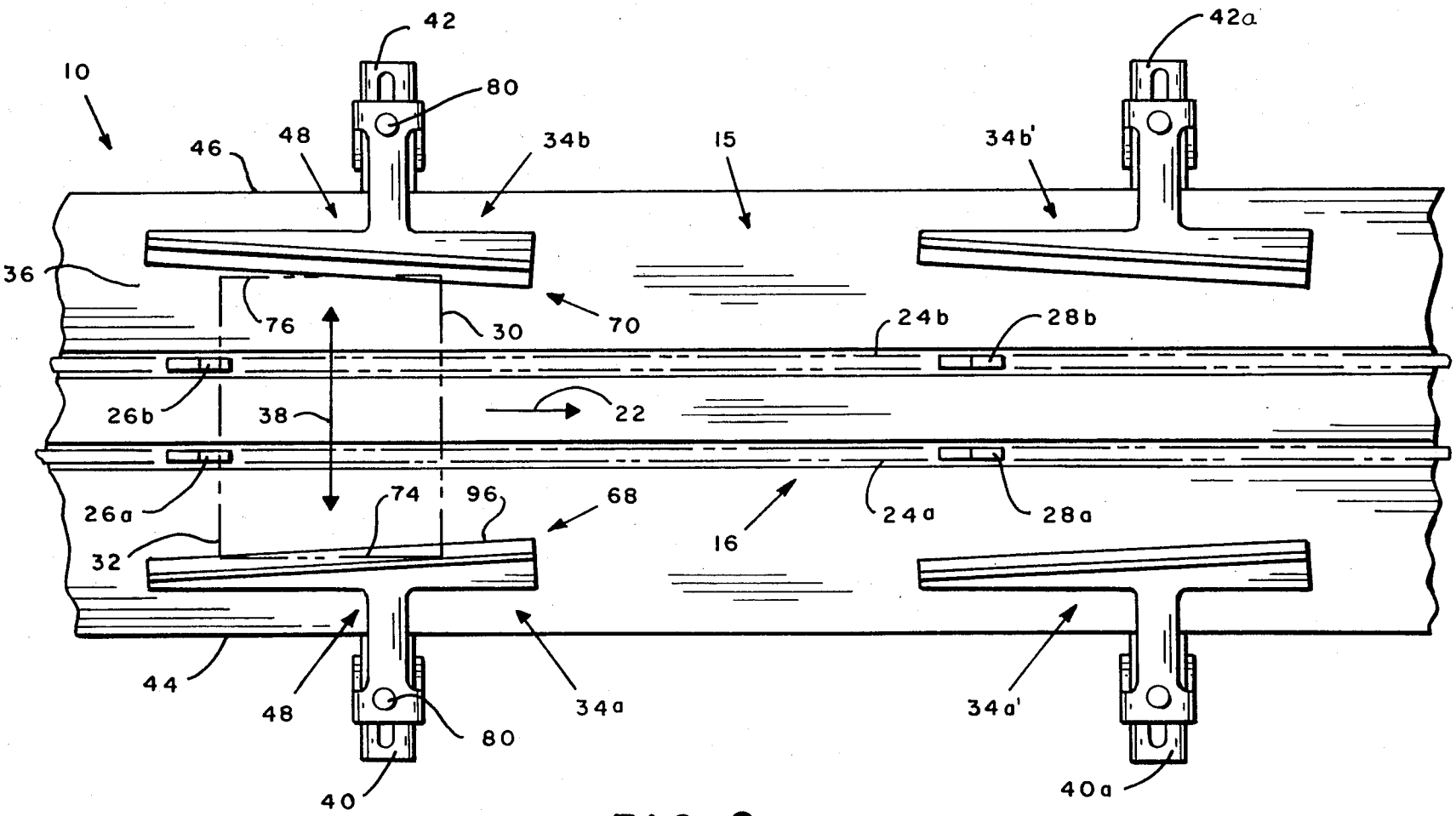
FIG. 2 is a plan view of the document guide apparatus and sheet conveying apparatus of FIG. 1, taken along the lines 2—2, without the surrounding and overlying apparatus and mechanism.

Referring back to FIG. 2, a pair of conveyor chains 24*a* and 24*b* have an attached plurality of aligned and spaced apart pusher members such as a pair of pusher members 26*a* and 26*b*, (FIG. 1 and FIG. 2). The pusher members 26*a* and 26*b* are shown pushing a piece of insert material 30 along the path 22. The pusher members 26*a* and 26*b* engage a trailing end 32 of the insert 30, while the feed deck 15 supports the insert 30 as well as other pieces of insert material which is spaced apart and being pushed along the path 22 by other pusher members such as the members 28*a* and 28*b*. A pair of registration devices 34*a* and 34*b* is used to control the lateral position of the insert 30 after it is delivered from the feeder and lands on an upstream portion 36 of the feed deck 15 which is located beneath the feeder 12. The registration devices 34*a* and 34*b* are adjustable in a lateral direction 38 as will be described in the following text.

There is a plurality of support members, such as a support member 40 and 42 which are fabricated of steel or other suitable material and each typically rigidly connected to the feed deck 15 by spot welding or the like. The support member 40 extends laterally outward from an edge 44 of the deck 15. The support member 42 extends laterally outward from an edge 46 of the deck 15. The other support members are similarly supported, suspended and spaced apart along the entire length of the machine 10.

Figure 3:
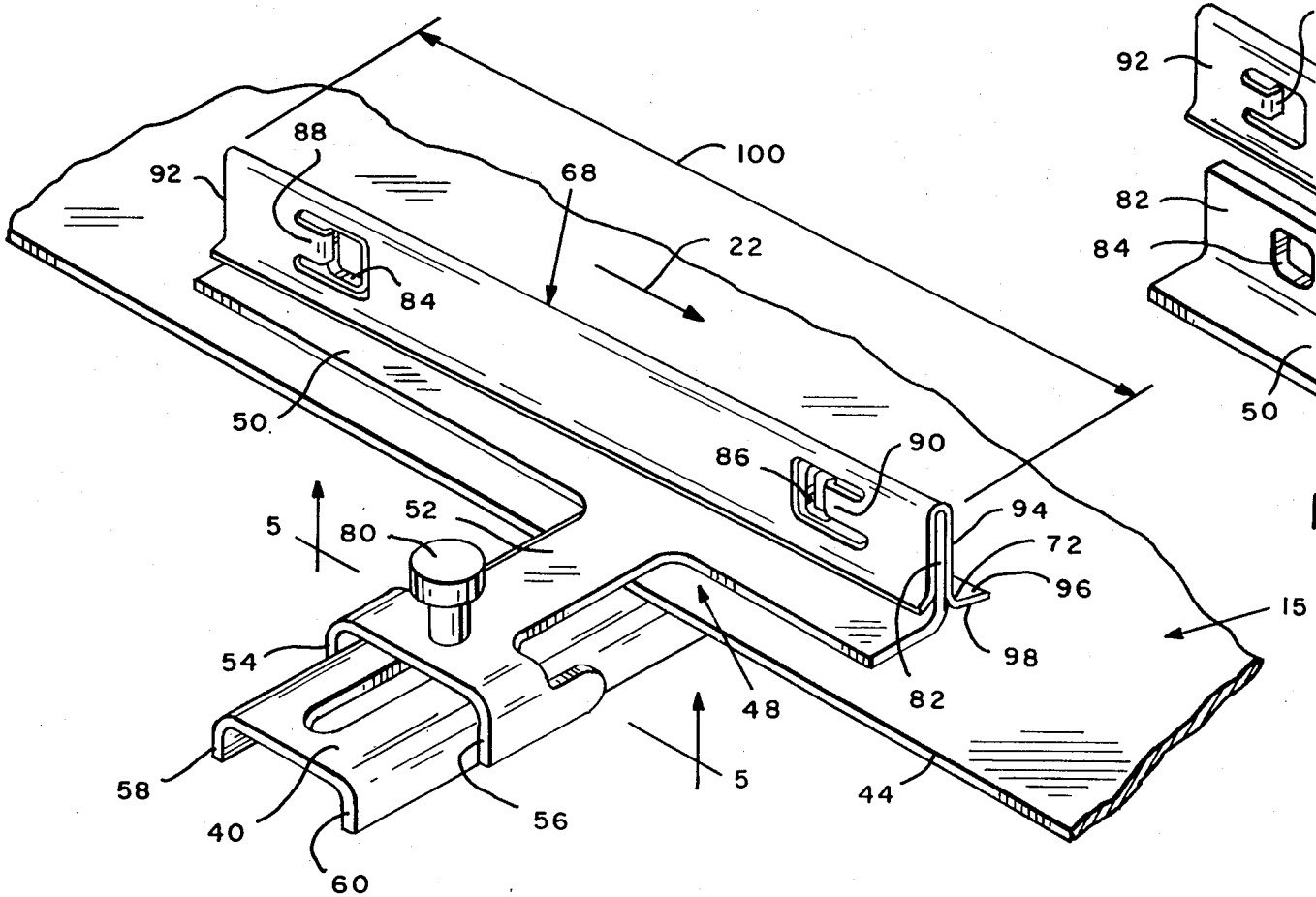
FIG. 3 is an enlarged isometric view of the front document guide apparatus adjacent to one feeder as taken from FIG. 1 of the operators side of the machine.
Figure 5:
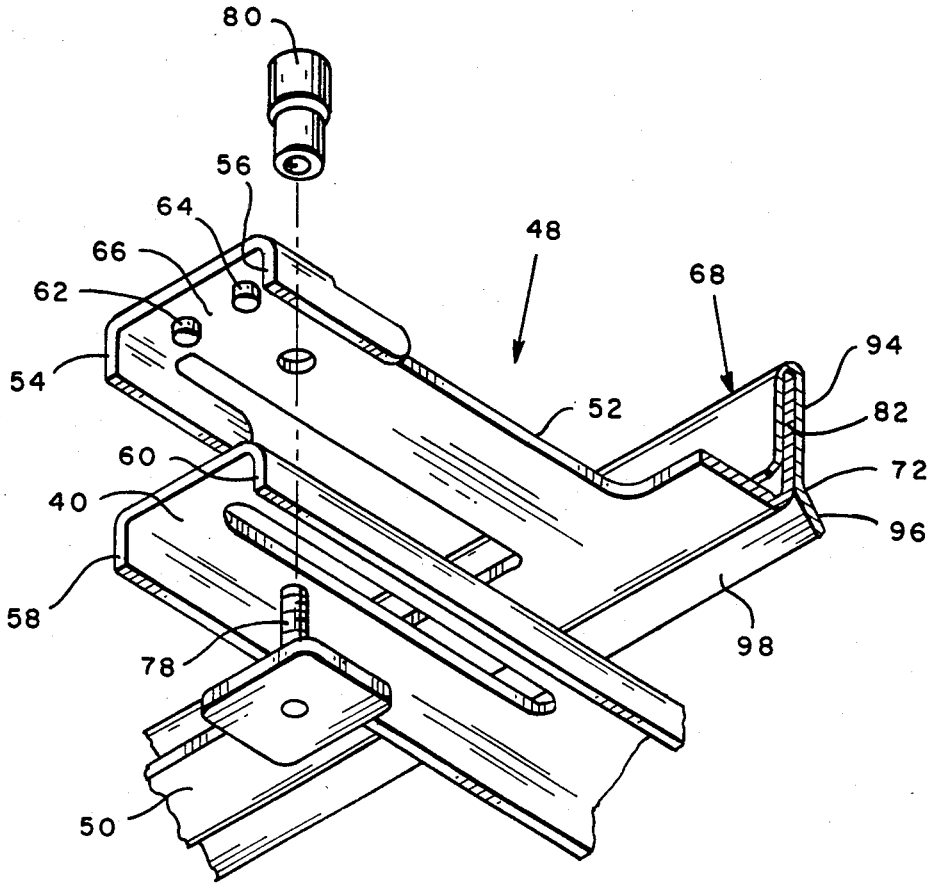
FIG. 5 is an enlarged isometric view taken along the lines of 5—5 from FIG. 3, showing the underside of the document guide apparatus in a disassembled condition.

The registration devices 34*a* and 34*b* are typical of a plurality of body members which are fabricated of a suitable metal such as steel and which are each slidably mounted on the support members. For example, referring to FIGS. 2 and 3, there is a body member 48 which overlies the feed deck 15 and which has a first portion 50 extending generally parallel to the deck 15 in the direction of the path 22. A second portion 52 is connected to the first portion 50 and extends laterally outward in the same direction and manner as the member 40 from the edge 44 of the deck 15. The second portion 52 of the body member 48 is generally U-shaped at the outboard end, having a flange 54 and 56 (see FIGS. 3 and 5), and which overlies the support member 40. The support member 40 is generally U-shaped by virtue of a flange 58 and 60, and is designed to fit snugly inside of the U-shaped member 48. The second portion 52 has a pair of raised bosses 62, and 64 (see FIG. 5) which are located on a bottom surface 66. The bosses 62 and 64 allow bending flexure of the member 48 which ensures that a registration guide member 68 is pressed against the deck 15. The member 68 and a corresponding registration guide member 70 form a horizontally disposed, funnel like, insert material guiding device (see FIG. 2), for laterally guiding the material while the pushers 26*a* and 26*b* move the material downstream along the path 22.

The registration guide member 68 has an L-shaped configuration which has a closed, unitary, internal corner 72 along which a lateral edge 74 of the insert material 30 is guided. It will be recognized that the member 70 is shaped similarly to the member 68, and provides the guiding function to an opposite lateral side 76 of the insert 30. It will thus be recognized that the members 68 and 70 guide other pieces of insert material as effectively as insert material which moves through the respective registration guide members located upstream or downstream of members 68 and 70.

The assembly of the registration guide member 68 on the body member 48 will now be described since the combination of these parts, a screw 78 and a knurled nut 80 (see FIG. 5) provide the necessary locking construction for slidable clamping of the associated parts in the lateral direction 38 to accommodate to varying lateral sizes of insert material. The side adjustment thus presents an opportunity for the machine operator to laterally shift the respective position of one size of enclosure material with respect to another, such that the enclosures may be laterally offset when deposited in a downstream envelope. Alternately, it is common to have the enclosures deposited in the envelopes so that they are laterally centered.

Figure 4:
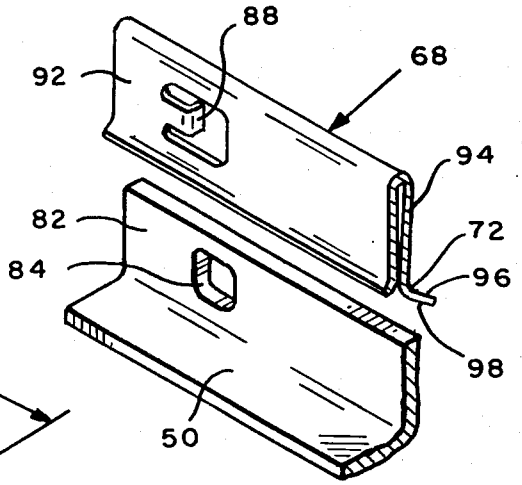
FIG. 4 is a detail view of the front document guide apparatus taken along the same lines as FIG. 3, with the apparatus disassembled.

The body member 48 has an elongate upstanding flange 82, (see FIGS. 3 and 4), which is generally L-shaped. There is a pair of suitable holes 84 and 86 located in the flange 82 for receiving a resilient tab 88 and 90 formed from a vertical portion 92 of the registration guide member 68. The resilient tabs 88 and 90 provide both lateral and vertical locking means to the flange 82. An upstanding leg 94 is thereby bent to a U-shape, suitable to snugly fit over the upstanding flange 82 of the body member 48. The leg 94 has a flange 96 formed therefrom, such that there is an angle formed between the leg 94 and the flange 96 which is greater than 90° when in a free, unclamped state, (see FIG. 4) and otherwise forms a substantially 90° angle defining the corner 72 when the member 68 is installed over the support body member 48, and firmly clamped down to the deck 15.

The body members 48 and other similarly disposed members are fabricated of a relatively thick 0.063"–0.078" material such as steel for the purposes of maintaining rigidity. The registration guide members 68 and 70 are fabricated of relatively thin (0.007") material such as ¼ hard, spring tempered stainless steel. It will be recognized by those skilled in the art that thicknesses, and materials other than those specified may be substituted to fabricate the described parts.

When the knurled nut 80 is rotated to provide clamping pressure to the body member 48, there is a static reactionary force upon the bosses 62 and 64, and upon a lower surface 98 of the flange 96 of the member 68. The force is taken up by the support member 40, and the feed deck 15, upon which the bosses 62 and 64 bear, thereby forcing intimate contact with the registration guide member 68. The net result is that there is not any gaps, seams, or apertures along the interface between the flange 96 and the deck 15. There is not therefore any possibility for an enclosure, sheet or piece of insert material to inadvertently become jammed or otherwise dislocated from the intended path of travel 22.

An additional benefit of the present invention lies in the fact that a length 100 (see FIG. 3) of the registration guide member 68 and 70 may be supplied in appropriate longer or shorter increments as well as higher sidewalls which may be directly compared to increasing or decreasing lengths of enclosures, sheets or insert material. This interchangibility is easily accomplished by lifting the tabs 88 and 90 so that they clear the slots 84 and 86 of the member 48. The member 68 or 70 may be lifted to clear the member 48 and the similar part which mounts the member 70. This will afford the opportunity for the machine operator to provide a proper guide for the documents being processed in a machine such as the inserter machine described in the foregoing specification. It will additionally be recognized by those skilled in the art that the registration devices described in the foregoing specification have been described with a view that it is understood that the associated parts are in effect mirror images of each other, that is, there is a front registration device, and a rear registration device, and close examination of the included drawings will reveal the nature of the duplicated and mirrored parts.

Therefore, having briefly described a registration device in detail for eliminating jams and undesired mishandling of documents in the feed path of an envelope inserting machine, it will be recognized that any modifications or changes to the parts or drawings of the parts described in the present specification will in no way alter the spirit and scope of the appended claims.

What is claimed is:

1. In an envelope inserting machine having an elongate feed deck, means for advancing insert material to be inserted into envelopes along said feed deck, and a plurality of insert material feeding devices spaced along said feed deck for sequentially feeding insert material onto said feed deck in registration with insert material advancing along said feed deck, registration devices for said insert material, said registration devices comprising:

a. a plurality of support members connected to said feed deck and extending laterally outwardly from said feed deck, b. a plurality of body members each having a first portion overlying said feed deck and extending parallel thereto and a second portion extending laterally outwardly from said first portion and overlying said support members, c. registration guide means mounted on said first portion of each of said body members for guiding said insert material into registration with other insert material on said feed deck, said guide means having a generally upright and L-shaped configuration defining a closed unitary corner along which the lateral edge of said insert material moves, and d. means for slidably clamping said second portion of each of said body members to the support member underlying said second portion of each of said body members in a desired lateral position with respect to said feed deck to force each of said guide means into intimate contact with said feed deck whereby said guide means forms a continuous horizontal support for said insert material to prevent said lateral edges of said insert material from being caught between the upper surface of said feed deck and said registration guide.

2. Insert material registration devices as set forth in claim 1 wherein:

a. said first portion of each of said body members includes an elongate upstanding flange extending generally parallel to said feed deck, and b. said registration guide means includes an upstanding flange connected to said upstanding flange of said body member and a unitary horizontal flange overlying said feed deck, said vertical and horizontal flanges forming said closed unitary corner.

3. Insert material registration devices as set forth in claim 1 wherein:

a. said first portion of each of said body members includes an elongate upstanding flange extending generally parallel to said feed deck, and b. said registration guide means includes an upstanding generally U-shaped portion which fits over said upstanding flange and a unitary horizontal flange overlying said feed deck, said U-shaped portion and said horizontal flange forming said closed unitary corner.

4. Insert material registration devices as set forth in claims 2 or 3 wherein said body members are formed of a relatively thick, rigid material and said registration guide means are formed of a relatively thin and highly flexible material, the thickness thereof being substantially the same as that ordinary paper.

5. Insert material registration devices as set forth in claim 4 wherein each of said registration guide means is manually biased to as to define an angle greater than 90° at said unitary corner so that when second portion of said body member is clamped to said support member said horizontal flange is pressed firmly against said feed deck.

6. Insert material registration devices as set forth in claim 5 wherein said upstanding flange of said first portion of said body members is provided with apertures and wherein said registration guide means include resilient tabs which extend through said openings to secure said registration guide means to said first portion of each of said body members.

* * * * *